United States Patent [19]

Bühler

[11] 4,438,801

[45] Mar. 27, 1984

[54] PROCESS AND APPARATUS FOR THE TRANSPORT OF A TRAIN OF FLASKLESS CASTING MOLDS

[76] Inventor: Eugen Bühler, Schleifweg 3, 8877 Burtenbach, Fed. Rep. of Germany

[21] Appl. No.: 315,532

[22] PCT Filed: Mar. 9, 1981

[86] PCT No.: PCT/DE81/00041

§ 371 Date: Oct. 23, 1981

§ 102(e) Date: Oct. 23, 1981

[87] PCT Pub. No.: WO81/02698

PCT Pub. Date: Oct. 1, 1981

[30] Foreign Application Priority Data

Mar. 24, 1980 [DE] Fed. Rep. of Germany ..... 3011265
May 29, 1980 [DE] Fed. Rep. of Germany ..... 3020349

[51] Int. Cl.[3] ..... B22D 47/02

[52] U.S. Cl. ..... 164/130; 164/323; 164/29

[58] Field of Search ..... 164/18, 27, 29, 323, 164/329, 330, 130; 198/462

[56] References Cited

U.S. PATENT DOCUMENTS 4,040,472 8/1977 Lundsgart ..... 164/323 X
4,180,156 12/1979 Popov et al. ..... 164/323 X

*Primary Examiner*—Kuang Y. Lin
*Attorney, Agent, or Firm*—Allison C. Collard; Thomas M. Galgano

[57] ABSTRACT

For transporting a train (15) of flaskless molds using a simply designed system along a storing, teeming and cooling run or part of a conveyor in a foundry so that the castings are made highly true to size, the forces needed for speeding up and slowing down the mold train (15) are caused to take effect at a desired level on the mold train (15) and, together with the forces acting oppositely to the thermal expansion of the molds (7) within the mold train (15), the forces are transmitted to the full length of the mold train only by the molds (7) themselves.

18 Claims, 6 Drawing Figures

15
7
13
8
11
12
6
25
26
27
28
17
16
127
10
20
29
19
31
32
33
18
30

PROCESS AND APPARATUS FOR THE TRANSPORT OF A TRAIN OF FLASKLESS CASTING MOLDS

The present invention is with respect to a process and an apparatus for the transport of a train of flaskless molds along a storing, teeming and cooling conveyor in a foundry and having at least one straight conveyor run, new teeming molds joining, one after the other, a back end of the mold train and filled molds being taken therefrom at the same rate from a front end of the train.

On working with flaskless molds, the reinforcing effect of a flask is not produced. Mold flasks are, generally speaking, high-price structures which have a very high wear rate and are very likely to be damaged. The use of flaskless molds, for this reason, keeps down running costs under the level if flasks are used. However, it has been seen from experience that, because there is no flask reinforcing effect, mold parts may be broken or bent or parts of them get out of line with each other. Furthermore, the mold parts may become greater in size than is desired so that more waste is produced. These shortcomings are not fully taken care of by known flaskless molding systems of the sort in question: For reinforcing the side faces of the molds, running in the transport direction, attempts have been made, it is true, at using gripping plates or guiderails or the like running along the length of the mold train. In most cases the end faces running normal to the direction of transport of the molds are not normally reinforced; if the molds have horizontal parting planes, or if the parting planes are upright, the end faces will frequently be acted upon by forces likely to be the cause of castings being produced which are not true to size.

German Auslegeschrift specification No. 2,417,197 is with respect to an apparatus of the sort noted with a wheel conveyor between a mold-producing station and a shake out station, the wheels turning about fixed axes and being used for supporting a palette with one horizontally parting mold on it. In the case of this known system, the palettes are longer than the molds. For this reason, the ends of the palettes are kept against each other for transmitting the forwardly acting and braking forces. The separate molds are spaced. Because the separate molds are not reinforced or gripped in the transport direction, it is possible for expansion to take place with the outcome that the castings may not be true to size. The thermal expansion taking place after teeming is frequently so high that the spacing between the molds as noted may be bridged over. If the expansion of the cope and the drag is different or if the cope is somewhat smaller than the drag in size, there may be undesired slipping of the cope on the drag, this danger being more specially likely in the case of a mold waiting its turn to be filled and next to the last mold to be filled. Quite in addition to this, however, the thermal expansion, which is not limited in the known system, of the molds is responsible for "growth" of the castings if a material is being processed which undergoes expansion while cooling down, for example with gray cast iron in the graphitization stage.

In the case of further known systems (see German Pat. Nos. 1,583,526 and 1,783,120), use is made of a power conveyor belt onto which the molds are pushed. On braking the conveyor belt the belt will, however, still go on moving to a certain degree uncontrolledly so that it is not possible to make certain that the molds are kept together without any spaces therebetween, this being necessary if they are to have the effect of supporting each other in the transport direction. If, in this respect, on the other hand the overall forward force takes effect on the last mold in the train, that is to say the last mold in the direction of transport, and the conveyor belt is moved by the mold, something which has been attempted more specially in the case of molds with upright parting planes, there would be an overgreat danger of the mold being crushed. In the case of such systems as well there is, for this reason, no regular and full reinforcement of the molds.

On the footing of this prior art, one purpose of the present invention is that of designing a process of the sort noted, and an apparatus for running the process, which make it possible for castings to be produced true to size in a way which so far has not been thought to be possible, while nevertheless taking care of the shortcomings of known systems.

The process of the present invention is characterized in that the molds, which have upright end and side faces normal to a conveyor plane, are lined up in the mold train with their end faces resting against each other, in that speeding up and braking forces adjusted as necessary and as needed for the transport of the mold train are caused to take effect on the train, the speeding up force taking effect at the back end of the mold train and the braking force taking effect at the front end thereof, such forces being transmitted together with any forces acting against thermal expansion within the said train along the full length of the train only by the molds from one mold to the mold next thereto.

Because of the supporting effect of the molds on each other in the transport direction and opposite thereto, the transmission of forces along the full length of the mold train is only through the molds themselves, this giving a useful effect. In other words, the molds have the desired effect of reinforcing each other at their end faces, which are normal to the direction of transport. The side faces, running in the direction of transport, of the molds may in any case, be reinforced or supported by gripping plates or the like so that, generally speaking, there is a flask-like reinforcement of the molds together with its useful effects in producing castings which are true to size and accurate. The fact that the driving and braking forces may be adjusted, gives the useful effect of its being possible to make changes from case to case by adjusting the forces acting from the outside on the mold train so that it is possible to put an end not only to undesired expansion of the mold train and undesired slipping of mold structures in relation to each other, but furthermore to any damage to mold parts. At the same time, because of this, the power needed may be decreased to the lowest possible level, this not only lowering running costs, but furthermore making it possible for the mold train to be moved smoothly without any blows.

In many cases, a specially useful effect is produced if, as a preferred part of the invention, the mold train, when not in the speeding up stage is pushed together, more specially in the resting stages, by an adjustable force acting oppositely to the thermal expansion forces of the molds so that the separate molds are reinforced. This measure may, more specially give a useful effect if the mold train has to be stopped, for example because the supply of liquid metal has run out. The thermal expansion taking place to a marked degree in such stages in which the molds are not moved in the prior art, is stopped in the invention by the force pushing a train together. A useful effect is produced if the force keeping the mold train together is greater than the force needed for completely stopping thermal expansion of the mold train. In this respect thermal expansion of the mold train is not then possible. As a further development of this teaching of the invention, the force keeping the mold train together may be smaller than the force needed for causing slipping of the mold or parts thereof waiting its turn to be filled next to the mold, which was last to be teemed up, on supports of said mold. In this way it is possible to make certain that, when overgreat forces are produced within the mold train, a certain stretching of the same may take place so that the forces are leveled off. However, the force pushing the mold train together is kept up. It is best for the molds to be so designed in this respect that the force necessary for causing slipping of that mold or parts thereof next to the last-filled mold and waiting its turn to be filled, on its support is in any case greater than the force produced by thermal expansion within the mold train so that no expansion of the mold train in fact takes place, even although normal thermal expansion forces take effect.

A transport apparatus for running the process as noted at the start, characterized in that, in the case of a conveyor stretching from a mold-producing station to a shake-out station and having at least one straight run, said conveyor having transport structures for supporting one or more molds and having turning supports for turning about fixed axes, the length of each transport structure as measured in the transport direction is smaller than the length of the mold or molds placed thereon, such mold or molds stretching out to the back and in front of each transport structure and in that the transport structures placed at the front and back ends of one run of the train are drivingly joined up with a driving unit and, in the other case, with a braking unit by way of at least one adjustable torque-limiting slip clutch. These measures make it possible to make certain that forces are transmitted by the molds themselves along the full length of the mold train and make it possible for the driving and braking forces to be changed from case to case, this furthermore being true of forces acting in the opposite direction to the thermal expansion forces. The measures of the present inventon furthermore make certain that the molds are kept on their separate supports in a resting condition even although they have the effect of supporting each other on transport. At the same time the fact that the sled or carriage-like transport units may readily be moved is important.

As part of a useful further development of these measures, the driving unit may be made up of at least one turning driving support or wheel joined up with a driving machine by way of a slip clutch, the driving machine being able to be locked, at least in the direction opposite to the transport direction and the brake unit is made up of at least one turning brake support or wheel which is joined up by way of the slip clutch with at least one brake machine which may be locked at least in the transport direction. The driving wheel and the braking wheel may, in this respect, best be designed for taking effect frictionally on the transport structures thereon in such a way that the force able to be transmitted thereby is greater than the greatest force which may be transmitted by the slip clutch, this having the effect of greatly decreasing wear. The wheels placed between the driving unit and the breaking unit may be designed as simple support wheels which are not powered so that a very simple structure is made possible.

As part of a further development of the invention, each run of the wheel conveyor is designed running downhill in the transport direction to such a degree that the resistance taking effect on its wheels is generally equalled by the downhill running effect completely. Because the friction is equalled there is, as a useful effect, generally the same level of supporting forces along the full length of the mold train between the separate molds. Furthermore, the force needed for moving the mold train may be kept generally low, so that it is smooth in operation.

It is frequently the case that as a new mold is joining the back end of the mold train, trouble conditions such as the parts of a mold being slipped in relation to each other, loss of form of mold parts or damage to mold parts such as breakage may take place, this, as well, having undesired effects on the accuracy of the castings. Molds coming up at the back end of the mold train have to be moved somewhat faster than the train so that they may come up against the back end itself. In order, in this respect, to make certain that the mold parts are not acted upon by blows, which might be responsible for the trouble conditions noted, as part of a further useful development of the invention, the joining up speed of the last mold in each case to be moved up to the end of the mold train is such that, as the mold comes up to the mold train, the kinetic energy freed is cushioned plastically by the mold material and in the case of molds with horizontal parting lines, such forces will not be the cause of the two mold parts being slipped in relation to each other. The speed by which the mold, joining the train, is faster than the train, is best not greater than 5 cm/s. For making this part of the process of operation of the apparatus possible, it is possible to have at least one supply unit in the form of a driving wheel, the driving wheel being joined up by way of a slip coupling, whose transmission torque may be adjusted, with a driving machine and it is designed for frictionally acting upon a transport structure supporting the mold. The slipping clutch may, in this respect, be adjusted to a generally low torque so that the driving machine has the effect of causing slipping of the clutch once the mold comes up against the back end of the mold train and, for this reason, there is no bending or other loss in form of the mold.

The adjustable torque slip clutches used may be designed, as a further useful development of the invention as contactless magnetic clutches and, more specially, magnetostatic hysteresis clutches so that there is no wear.

Further useful developments and outgrowths of the general teaching of the invention responsible for good effects will be seen from the account now to be given of preferred working examples of the invention using the figures, and from the dependent claims.

Figure 1:
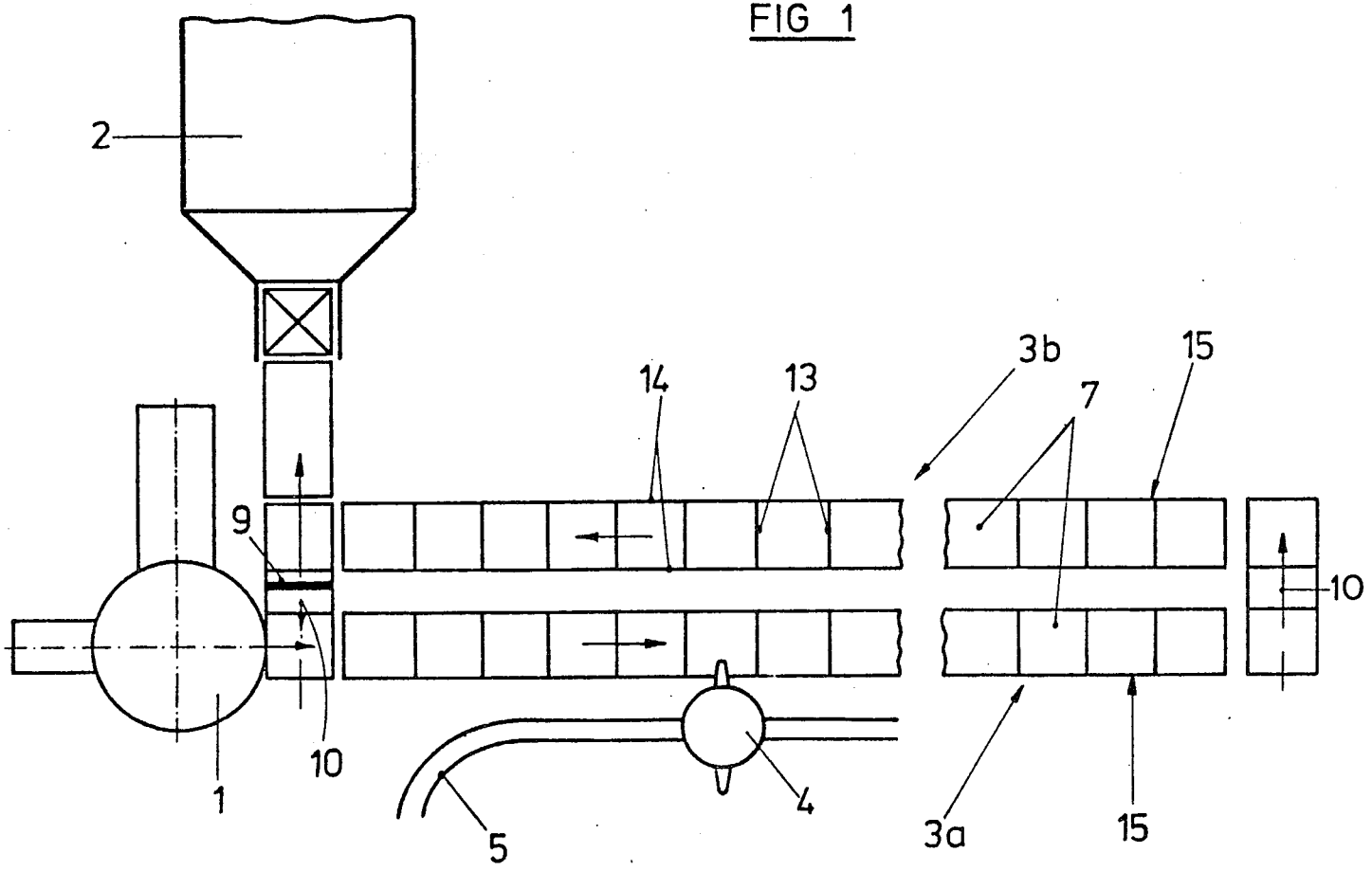
FIG. 1 is a diagrammatic, general view of a teeming plant using molds with horizontal parting lines and transported on palettes, the molds having a storing, teeming and cooling conveyor with two parallel runs.

A foundry plant of the sort to be seen in the figures is made up, as may best be seen from FIG. 1, of a mold-producing station 1, in which flaskless casting molds are made, a shake-out station 2, in which mold sand is cleared from the completed castings, and a storing, teeming and cooling down conveyor 3*a*, 3*b*, on which the molds make their way from the mold-producing station 1 to the shake-out station 2. The part of the conveyor coming after the mold-producing station is a storing part for offering up completed molds for filling with metal. Next there is the teeming conveyor part in which a ladle 4 full of metal is used for filling the molds. There is a metal line at 5 for supply of metal from a melting furnace (not figured) to the ladle. After the teeming part of the conveyor with the ladle 4 there is the cooling part in which the castings are cooled down till they are at the shake-out temperature. In the plant of FIG. 1 the storing, teeming and cooling down conveyor is made up of two conveyor runs working in opposite directions.

For forming the storing, teeming and cooling down conveyor with its two runs moving in forward and backward directions there is a wheel conveyor run 6 with wheels turning about fixed axes. For taking up the molds, numbered 7, and which in the present case are double-block molds with a horizontal parting plane between a cope 11 and a drag 12, transport structures are placed running on the wheels of wheel conveyor run 6, such transport structures in the present case being in the form of palettes 8 each supporting one mold 7. At the end of the cooling down part of the conveyor, the palettes 8 are cleared from the conveyor by a pushing plate marked 9 in FIG. 1 and then put on to the back end of the forwardly moving conveyor run for taking up a new mold as it comes out of the mold-producing station 1. At the other, front end of the forwardly moving conveyor run, the palettes 8 together with the molds 7 thereon, are moved over onto the other, backwardly running conveyor run and, for this purpose, there are at ends of forwardly running conveyor run 3*a* and of the backwardly running conveyor run 3*b* moving over units acting in the direction of arrow 10. Such units may take the form (see FIG. 3) of a carriage having a lifting system and able to be moved in the direction normal to the conveyor direction. The copes 11 and the drags 12 of the horizontally parting molds 7 are, in the present working example of the invention, to be quite the same in size and they have end faces 13 and side faces 14 which are normal to the plane of transport or of the conveyor. The length of the molds 7 is, as may be seen from FIG. 2, greater than the length of the mold palettes 8, at least in the transport direction so that the molds 7 may be placed on the palettes 8 with their ends sticking out at the front and the back past the edges of the palettes. For this reason, the molds may have their upright end faces resting against each other so as to give a direct supporting effect and in the forwardly moving conveyor run 3*a* and the backwardly running, opposite conveyor run 3*b* of the storing, teeming and cooling down conveyor two trains 15 of molds are produced without any spaces inbetween them, see FIG. 1. For this reason, the transmission of forces, that is to say the driving, braking and possible thermal expansion forces within each mold train 15 goes by way of the molds 7, the palettes 8 on which they are rested not being used for the transmission of forces. Because the molds have their end faces resting against each other, a certain reinforcing effect is produced, this making certain that the castings are produced true to size.

Figures 2, 3:
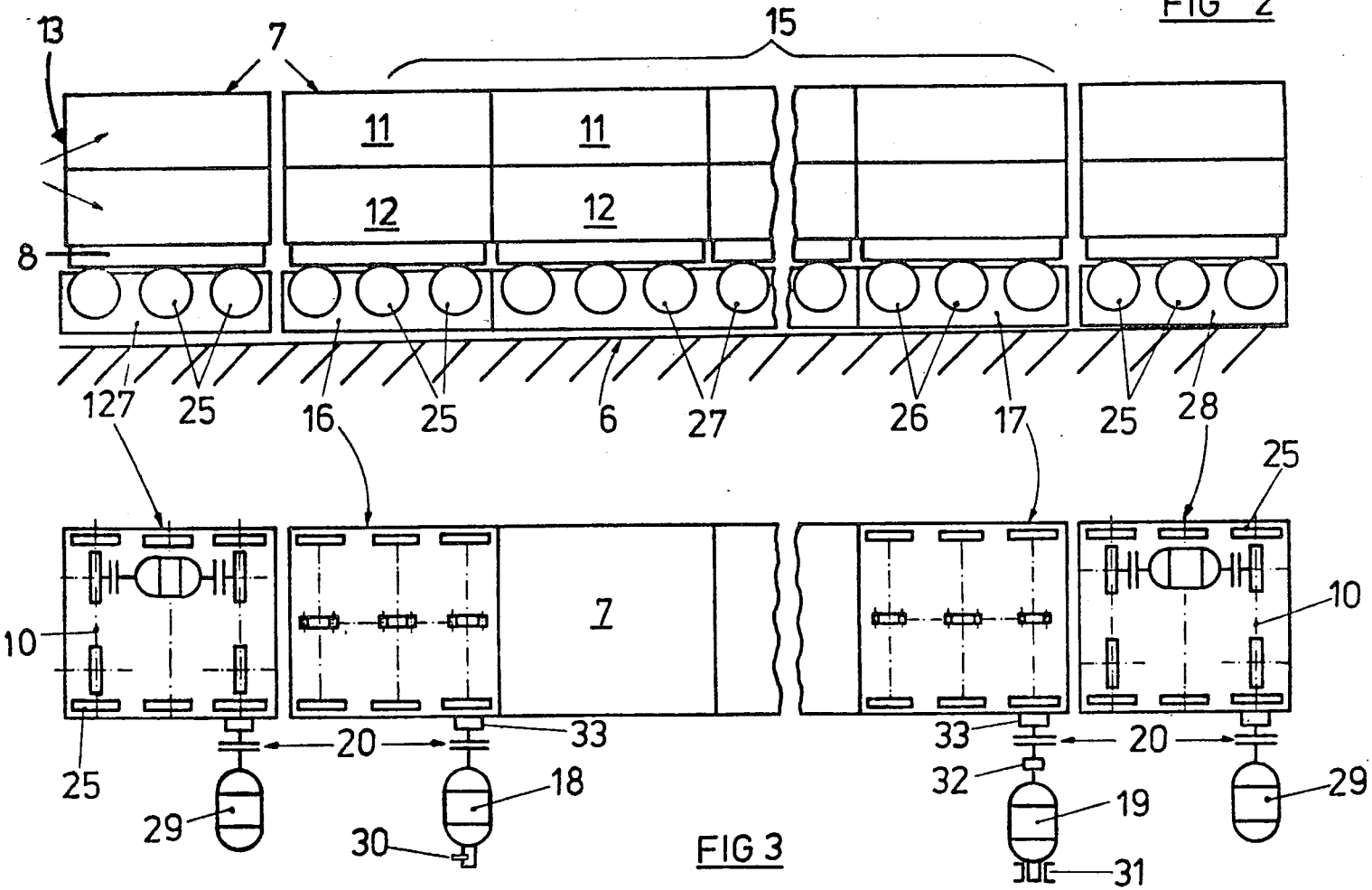
FIG. 2 is a side view of one run of the storing, teeming and cooling conveyor of FIG. 1.
FIG. 3 is a plan view of the system of FIG. 2 without some of the palettes.

Each of the mold trains 15 has, as may be seen from FIGS. 2 and 3, a driving unit 16 placed at its back end and which, in the present case, is best made part of the wheel conveyor run 6, while at the other, front end of each conveyor run, there is a braking unit 17 which is best made part of the wheel conveyor run 6 as well. The driving unit 16 and the braking unit 17 (see FIG. 3) have a driving machine 18 and, in the other case, a braking machine 19 acting through a driving connection with, in each case, a torque limiting or slip clutch 20, whose limiting effect may undergo adjustment so that the driving forces acting on the mold train 15 and the braking forces acting thereon may be changed at will, this making certain that no uncontrolled forces take effect on the mold train 15 in question so that the molds 7 are carefully, that is to say not roughly, processed. The driving unit 16 and the braking unit 17 are made up, as may be seen from FIG. 2 furthermore, of at least one driving wheel 25 and, in the other case a braking wheel 26 on which the palettes, heading for the end of the conveyor run, are frictionally rested. For stopping wear, this friction effect is best stronger than the greatest possible torque which may be transmitted by the slip clutch 20 in question so that if there is any slip, it will take place at the clutch and not between the wheel 25 or 26 and the palette. The wheels of the wheel conveyor run 6, placed between the driving unit 16 and the braking unit 17 are best designed in the form of freely running support wheels 27. In place of wheels 25, 26 and 27 it is furthermore possible to have rollers stretching over the full breadth of the wheel conveyor run 6. In the present working example of the invention, the wheels are paired and placed on opposite sides of the conveyor. Furthermore, in the present working example, the driving unit 16 and the braking unit 17 are designed stretching along the length of one palette 8 in view of the fact that they each have three pairs of wheels so that the driving and braking forces may be transmitted whatever the adjustment of the slipping clutches 20 completely and without any slip. As a driving machine 18 and a braking machine 19, use is best made of electrodynamic geared machines. For overcoming effects of friction of the two-wheel conveyor runs 6, they are at such a slope to the horizontal (see FIG. 2) that the bearing friction taking effect on the wheels, and other forces acting against motion of the mold trains are balanced by the downhill driving effect of the palettes 8 and their molds 7 on the conveyor runs.

In the resting, stopped condition, the driving machine 18 is at least stopped from turning in a direction opposite to that of transport while the braking machine 19 is locked for stopping motion in the transport direction and, for this purpose, the driving machine 18 may have a ratchet 30 while the braking machine 19 may have a locking brake 31 which automatically takes effect when the machine is stopped. Inasfar as the train of molds kept together in this way is acted upon by thermal expansion forces having the tendency of increasing the length of the train, such forces are stopped from taking effect by the locked driving machine 18 and the locked braking machine 19 up to a force level as fixed by adjustment of the slip clutches 20, that is to say the forces within the train do not have any effect outside the train. The slip clutches 20 are, for this reason, best so adjusted that no slip takes place because of thermal expansion, that is to say, putting it differently, there is no increase in length of the mold train 15. The thermal expansion forces may be readily worked out or measured because, as tests have made it clear, there is no summating effect along the length of the train.

With the adjustment noted of the slip clutches 20, a slipping of the complete molds 7 on the palettes 8 or of the copes 11 on their drags 12 might be feared, but, however, the force necessary to take care of any such slip may be readily worked out by testing and is normally known. Slipping of the molds 7 on the palettes 8 or of the copes 11 on the drags 12 does not take place if the force needed for producing such slip is greater than the force produced by thermal expansion. This condition is readily kept to if the molds 7 have the effect of supporting each other, as in the present working example, because the copes and drags are of the same size so that there is a full support of drag against drag and cope against cope along the train; furthermore at the back of a conveyor run, the first mold to be filled, and in which thermal expansion may take place, would have to have the effect of pushing all molds in the storing run of the conveyor to the back of it so that the slip-producing force as measured for one mold, is multiplied. In the case of molds whose copes are somewhat smaller than the drags so that the copes are not rested against each other, the same effect may be produced by weighting the molds and in order, in cases of this sort to see that there is no slip of the copes on their drags in the storing run of the conveyor with molds 7, the forces which may be transmitted by the slip clutches 20 may be adjusted to a value which is a little less than the force which would produce slip between the copes and drags, so that it would be more likely that there would be a small change in the length of the train of molds 15 than a slipping of the copes on the drags of the molds in the storing conveyor run. This case is, however, unlikely under normal running conditions.

For getting on the move and speeding up the mold train 15 so that it is moving at the normal operation speed, the driving unit 16 is put into operation for producing the necessary force for getting the mold train 15 started up. The adjustment of the slip clutch 20 of unit 16 is, in this respect, representative of the limit of the speeding up force. Putting into operation the braking unit 17 with the braking machine 19 is not necessary at this stage, but the locking brake 31 has to be taken off. The parts of the braking unit 17 are, in this case, simply turned by way of the palettes 8 moving over the braking wheels 26. In this respect, friction, for example of the geared machine 19 has an effect opposite to the force moving the molds along. The speeding up or acceleration forces transmitted by way of the one end face 13 of a mold to the next mold 7 become less and less towards the front end of the conveyor run. For this reason, more specially the back part of the mold train in which thermal expansion is likely to have undesired effects is, for this reason, safeguarded because the molds 7 are locked against each other with a reinforcing effect. Once the train has been speeded up to the transport speed, the brake machine 19 is out into operation, this keeping the transport speed at an unchanging level. This is possible by operation of brake 31. The braking force acting on the mold train is, in this respect, the same as the force for which torque transmitted by the slip clutch 20 is responsible. The slip clutch used with the braking machine 19 is best adjusted to a somewhat lower torque than the slip clutch 20 of the driving machine 18 so that the effect of the driving force is somewhat greater than that of the braking force. In the working example figured, the geared machines 18 and 19 for driving and braking, are put into operation at the same time. In the speeding up stage, the geared braking machine 19 is turned without producing any braking force and, for this purpose, there is a freewheel 32, placed in the driving connection with the brake wheels 26, and letting the wheels 26 be overtaken. Once, however, the braking wheels 26 are turned by the palettes 8 more quickly than the geared braking machine 19 or the output of the gearbox used therewith, freewheel 32 will be a force-transmitting part so that the braking machine 19 is now turned by the braking wheels 26. The electrodynamic machine 19 is, in this case, run as a generator. The braking force acting on the mold train 15 is then the same as the generator force. Once the generator function of breaking electrodynamic 19, which may an electric motor, is started, it has the effect of controlling speed. With the help of the braking machine which, at first, may be turned freely by way of the freewheel 32, but which is run as a generator after overtaking by the train 15, the useful effect may be produced of automatically and exactly sensing the end of the speeding up stage with the outcome that a very even motion of the train is made possible. The speed ratio of the gearbox of the braking machine 19 is best made somewhat smaller than the speed ratio of the gearbox used with the driving machine 18 so that, with the same speed of the machines at the braking unit, there will be somewhat smaller gearbox output speed than at the driving unit, this making certain that, even in the last part of the speeding up stage and in normal forward motion, a controlled, certain generator force is on hand as a braking force so that the train of molds is kept together completely regularly or kept lined up.

The gearboxes for the driving machine 18 and the braking machine 19 may be united with such machine or, as is to be seen in the present working example, may be in the form of a separate gearbox marked 33. For stopping the motion of the mold train, the driving unit 16 is put out of operation by switching off the dynamo electric machine 18 and, at the same time, the brake 31 of the braking machine 19 is put into operation so that the braking machine 19 (an electric motor) is locked and stopped. The braking force acting on the train of molds is, in this case, the same as the force produced by the torque which may be transmitted by the slip clutch 20 in question. The locked brake 31, together with the automatically working ratchet 30 at the driving unit 16, is responsible for the gripping of the molds in the train between each other, desired more specially when the train is not on the move, between the driving unit 16 and the brake unit 17 so that there is in fact a reinforcing effect on the molds 7.

Figure 4:
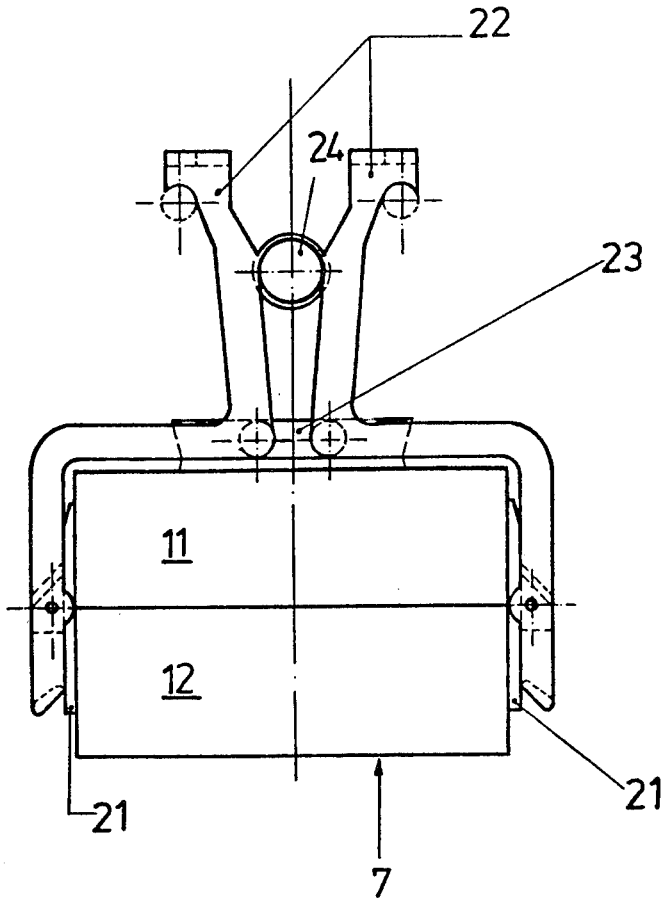
FIG. 4 is an end-on view of a horizontally parting mold as in FIG. 1 with side reinforcing plates.

In addition to the end-on reinforcing effect on the molds 7, the side faces 14 may be reinforced and, for this purpose, as may best be seen from FIG. 4, gripping plates 21 may be used taking effect against the side faces 14 of the molds 7. In the working example to be seen, the gripping plates 21 are joined together by two-armed angled levers 22 or bell cranks forming a weighting iron part 23 placed on the cope 11 for keeping it down and weighting it. The angle levers 22, together with their arms running out past the sides of the weighting iron part 23, and forming opening scissors structure, in which, for giving a self-locking effect and producing further weighting of the cope, a heavy bar 24 may be placed. Together with the supporting or reinforcing of the ends of the molds and the gripping effect on the mold train, there is a reinforcing of the molds 7 on all their upright sides which is equal in effect to a flask and which makes it possible for the castings to be produced true to size in a way which, before the present invention, was not thought to be possible.

For moving up new molds as produced by the mold-producing station 1 against the back end of the mold train 15 there is a supply unit 127 coming before the driving unit 16, while, coming after the braking unit 17 of each train 15, there is a moving over unit 28 for moving the furthest forward mold of the mold train to be taken and pulled from the front end of the conveyor run. The supply unit 127 and the moving over unit 28 are made up in the present case (see FIG. 3) as well of three pairs of driving wheels 25 which, by way of slip clutches 20 which may be adjusted for changing the torque clutched thereby, are joined up with a driving machine 29. Because at the supply unit 127 and the moving over unit 28 only one palette with its mold has to be speeded up and got on the move, the slip clutches 20 may be adjusted to a generally low torque transmission so that the driving machines 29 used therewith will be slipping, even if there is only a small resistance, this being for stopping any damaging forces acting on the mold in question. A pushing or forward force of the supply unit 127 of the order of 100 N has turned out to give a good effect. The supply unit 127 and the moving over unit 28 are run at a speed a little greater than the transport speed of the mold trains with which they are used so as to produce the desired supply and handing over effect and the difference in speeds at the supply unit 127 is best such that the kinetic energy freed here when the mold comes up against the back end of the mold train on joining the train is cushioned within the plastic range of the mold sand and does not have the effect of moving the cope in relation to the drag thereunder. A speed difference of the order of 5 cm/s has been seen to be more specially useful. In the present working example, the moving over unit 10 are united with the supply unit 127 and the moving over unit 28. If, as in the present working example, one driving machine and the slip clutch 20 joined therewith is to be used for driving a number of wheels or pairs of wheels, the wheels are naturally enough drivingly joined up by chains, gearwheels or the like.

Figure 5:
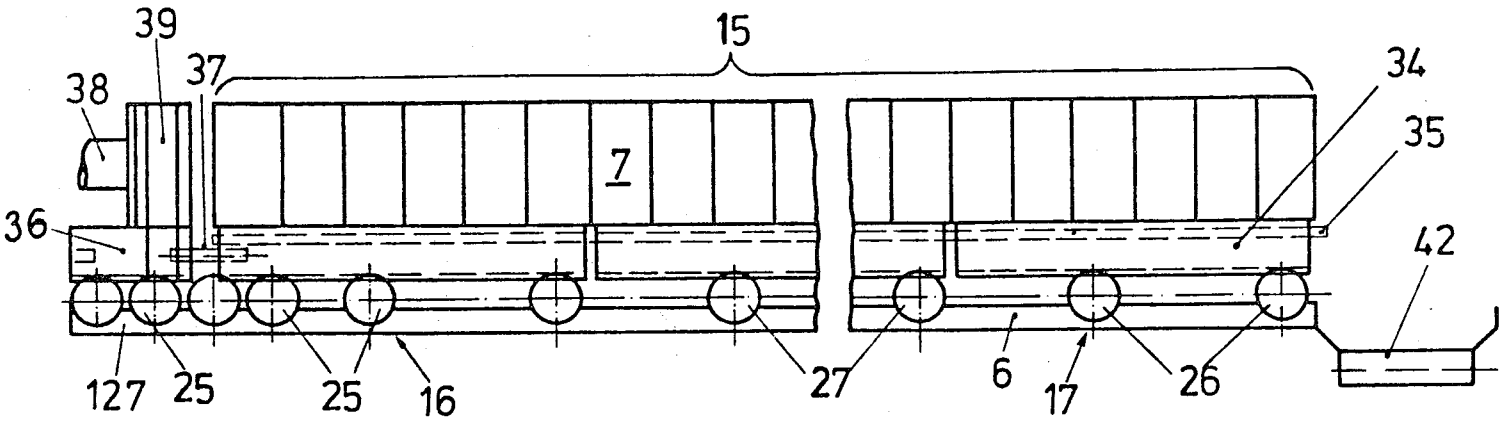
FIG. 5 is a side view of a storing, teeming and cooling down conveyor with a train of monoblock molds having upright parting planes and placed in a train one after the other, the conveyor being a walking beam conveyor.

FIGS. 5 and 6 are again a view of a transport system for a mold train 15 made up of molds 7 with upright parting planes or lines. Such molds may, for example, be monobloc molds which are all the same in the case of FIG. 5 or of "double block" molds, each made up of a cope and a drag which, after being produced, are turned through 90°, see FIG. 6. The transport of the mold train 15 is, in this case, undertaken in steps as the train is joined by new molds coming from the mold-making station, not figured. In the stage in which the train is on the move, the molds 7 of the train, which do not have any spaces between them, are rested on a number of transport structures placed one after the other, such transport structures being walking beams 24, whose beams or rails are placed singly between support beams 35 stretching along the full length of the mold train 15, such support beams or rails having the necessary play between them and the walking beams 34. The support beams 35 are not moved in the length-direction. The walking beams 34 are taken up by a wheel conveyor run which in design and function is generally like the wheel conveyor run 6 to be seen in FIGS. 2 and 3. For this reason, like parts are given like part numbers. The wheel conveyor run 6, for this reason, in the present working example as well, made up of driving wheels 25 for forming a driving unit, braking wheels 26 at its front end for forming a braking unit and freely running support wheels 27 placed between the driving and braking units. The driving wheels 25 and the braking wheels 26 are joined in the present working example by way of a slip clutch in each case, whose torque transmission may be adjusted, with a geared machine, that is to say in the one case as a driving machine while in the other case (of the braking wheels 26), use is made of a geared machine as in the FIGS. 2 and 3 with a locking brake of the same sort as marked 31 in FIG. 3; furthermore, in the driving connection and the braking unit there is a freewheel 32 as in FIG. 3. The operation of the system on speeding up, transport and braking is the same as detailed in connection with FIGS. 2 and 3. The walking beams 34 in the case of the present working example are used for transporting a number of molds 7, placed one after the other, at a time. The length of the walking beams 34 is, however, such that the molds 7 placed thereon have a somewhat greater overall length. On lining up the molds in the right way, it will be seen that, for this reason, the molds will be sticking out to the front and the back so that the transmission of power on motion of the walking beams 34 is only within the mold train 15 so that the same is kept together even when it is on the move and the effects of inner thermal expansion are limited or made of no effect, the slipping torque of the clutch used with the driving wheels 25 being adjusted to such a value that only the force (and no greater force) needed for moving forward and accelerating the mold train 15 is produced. The slip clutch joined up with the braking wheels 26 may, in this respect, be adjusted to a somewhat smaller value.

In the rest stages, caused for example when liquid metal has run out, the mold train 15 may be taken up by the walking beams 34, the driving wheels 25 being locked against turning in a direction opposite to the transport direction and the braking rolls 26 being locked against turning in the transport direction for stopping thermal expansion in the length-direction of the mold train 15, as was the case with the working example of the invention of FIGS. 2 and 3.

In this case as well a ratchet in the one case and a locking brake in the other, may be used. The force acting against the thermal expansion force is in line with the force representative of the torque transmission for which the clutches 20 are adjusted and which, for completely stopping any thermal expansion in the length-direction, is best greater than the thermal expansion force. If the mold train 15 is supported on the support beams 35 in the resting stages, thermal expansion will furthermore be stopped by the friction force where the molds are rested on the support beams.

Figure 6:
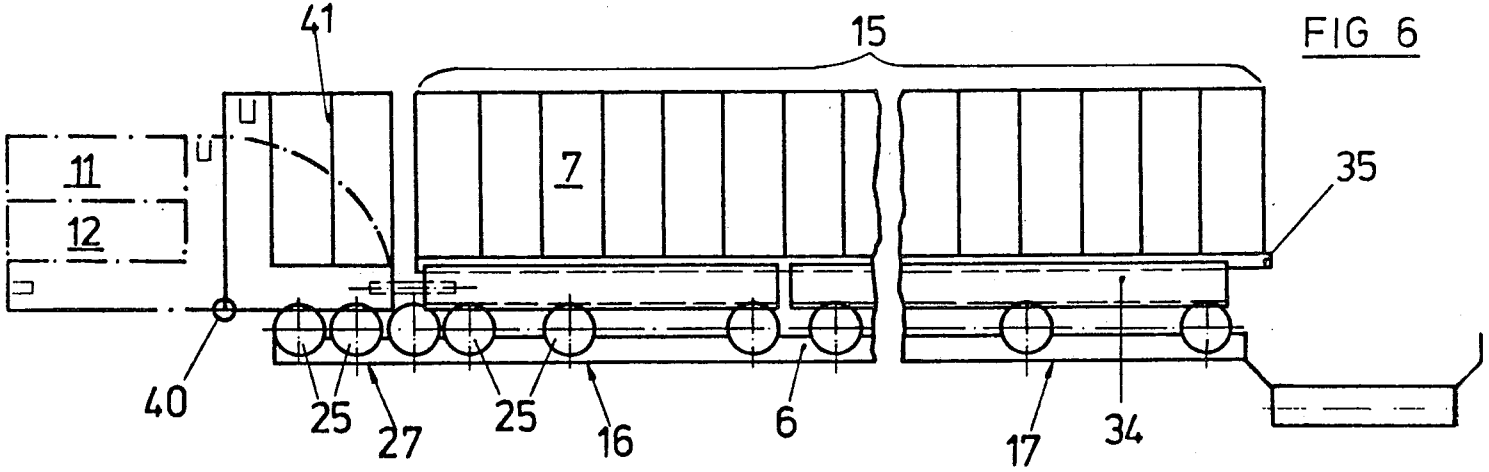
FIG. 6 is a side view of the structure of FIG. 5 in a resting stage, the conveyor supporting double block molds having upright parting planes.

The support beams 35 and the walking beams 34 used as transport structures, may be changed in level in relation to each other so that the mold train 15 is supported on the walking beams 34 (see FIG. 5) or on the support beams 35 (see FIG. 6). The mold train 15 when resting on the walking beams 34 is moved by the beams 34 in each step by a distance equal to the length of one mold forwards and at the end of such step is taken up by the support beams 35 and then the walking beams 34, clear of the molds, are moved back into their starting positions. This may be done for example by changing the direction of motion of the driving wheels 25. In this respect, the distance between the separate walking beams to be kept the same by parts moving with the beams. However, the beams are freed as soon as the walking beams come up against the train.

Between the walking beams 34 furthest to the back and the mold-producing station, not figured, there is a supply unit 127 which is made up of a pusher carriage 36 supported on driving wheels 25 and which has beams with the same spacing between them as the walking beams 34, such beams being able to be moved between the support beams 35. The pushing carriage 36 is joined up with the next walking beams 34 by way of guidepins 37 making certain that the two system are truly lined up. For lining up the mold which may be pushed onto the carriage 36 by a stamp 38, adjustable breast plates 39 are present, of which one may be fixed against an adjustable stop on the frame of the carriage 36 and the other may be moved by a piston-and-cylinder unit so that the mold, pushed inbetween plates 39 is pushed against the adjustable plate and, for this reason, moved into the true position. For double-block molds made up of a cope 11 and a drag 12 use will be made of a carriage with forks at an angle and which, see FIG. 6, may be turned about axis 40 through 90° so that the mold parting lines 41 are then normal to the transport plane.

The driving wheels 25 used with the supply unit 127 are, as well, joined up by way of an adjustable slip clutch with a driving motor. The torque transmitted by this slip clutch is to be so adjusted in this respect that the mold moving force produced thereby is about 100 N. Once the resistance of the mold as it comes up against the back end of the mold train 15 gets to this force, there will be slipping of the clutch so that the mold will certainly not be bent or otherwise damaged. The speed of the driving wheels 25 of the supply unit 27 is adjusted to such a value in this respect that the mold joining the moving train 15 is about 5 cm/s faster than the train itself. The kinetic energy freed when the mold comes up against the back end of the mold train 15 is then cushioned plastically by the mold material so that there is no sharp blow against the end of the train and, for this reason, no loss of form or other damage. A new mold is best joined up with the back end of the mold train 15 when the walking beams 34 are causing forward motion of the molds, the support beams 35 being lowered. On backward motion the furthest forward mold 7 in the train is pushed clear onto a transport unit 42 running onto a shake-out station, which is not detailed in the figure. The backward motion of the carriage 36 into its starting position may be best caused as well be changing the direction of turning of its driving wheels 25, although it would furthermore be possible for the walking beams not to have their own driving system and for them to be joined up with the carriage 36, for example by a transport chain acting on the walking beams 34 and the carriage 36.

The slip clutches 20 used in the present invention are best designed as contactless magnetostatic hysteresis clutches so that there is no wear.

I claim:

1. A process for the transport of a mold train of flaskless molds on movable transporting structures along storing, teeming and cooling stations in a foundry and having at least one straight conveyor run on which said transporting structures are supported, new teeming molds joining, one after the other, a back end of the mold train and filled molds being taken therefrom at the same rate from a front end of the train, comprising the steps of:

(a) lining up said molds in said mold train with their end faces resting against each other, said molds having upright end and side faces normal to the conveyor plane;

(b) transporting said mold train by speeding up and braking forces adjusted as necessary and as needed, said speeding up force taking effect at the back end of said mold train and said braking force taking effect at the front end thereof; and (c) transmitting said forces together with any forces acting against thermal expansion within said mold train along the full length of the mold train only by said molds, from one mold to the mold next thereto.

2. The process as defined in claim 1, which further includes the step of maintaining said mold train together in the resting stages by an adjustable force acting oppositely to the thermal expansion forces of said molds.

3. The process as defined in claim 2, wherein said step of maintaining said mold train together includes applying a force greater than the force needed to completely overcome the thermal expansion of the mold train.

4. The process as defined in claim 2, wherein the force keeping the mold train together is less than the force needed for causing slipping of the mold or parts thereof next to the last-filled mold and waiting its turn to be filled, on its support.

5. The process as defined in claim 2, wherein the force necessary for causing slipping of the mold or the parts thereof next to the last-filled mold and waiting its turn to be filled, or its support is greater than the force produced by thermal expansion within the mold train.

6. The process as defined in claim 1, wherein the speed of a new mold joining the mold train to the back of the last mold therein is such that as this mold comes up against the back end of the mold train, the kinetic energy freed is plastically cushioned by the mold material, and in the case of horizontally parting molds such force is not great enough for causing slipping of the cope in relation to its drag, the force used for moving forward the new mold more specially being 100 N at the most.

7. The process as defined in claim 6, wherein the speed of a mold joining the train being at the most 5 cm/s greater than the speed of motion of the said mold train.

8. Apparatus for casting including flaskless molds and a conveyor for transporting a mold train of said flaskless molds along storing, teeming and cooling stations and having at least one straight conveyor run, new teeming molds joining, one after the other, a back end of the mold train and filled molds being taken therefrom at the same rate from a front end of the train, wherein said conveyor stretches from a mold-producing station to a shake-out station and includes turning supports turning about fixed axes, and said conveyor including transport structures for supporting one or more molds having a length in the transport direction smaller than the length of the mold or molds placed thereon, said mold or molds stretching out to the back and front of each such transport structure, and said transport structures placed at one of the front or back ends of one run of the mold train are geared with a driving unit and at the other end with a braking unit by means of at least one adjustable torque limiting slip clutch.

9. The apparatus as defined in claim 8, wherein said driving unit includes at least one wheel joined with a driving machine by means of a slip clutch, said driving machine being lockable, at least in the direction opposite to the transport direction, and said braking unit includes at least one braking wheel which is joined by means of a slip clutch with at least one braking machine which may be locked at least in the transport direction, said driving wheels make frictional contact with the transport structures resting thereon and the force which is transmittable by the driving and braking wheels is greater than the greatest force which may be transmitted by the slip clutch, and said turning supports placed between the driving unit and the braking unit are free running wheels.

10. The apparatus as defined in claim 8, wherein each run of the conveyor is directed to run downhill in the transport direction to the degree that the resistance taking effect on its turning supports is at least equal to the downhill driving effect of the train.

11. The apparatus as defined in claim 9, wherein the driving machine of the driving unit and the braking machine of the braking unit are powered together at least in the speeding up stages and forward motion of the mold train coming thereafter in the transport direction, and the starting up speed of turning at the braking unit is lower than at the driving unit and the torque which may be transmitted by the slip clutch of the braking unit is less than the torque which may be transmitted by the slip clutch of the driving unit.

12. The apparatus as defined in claim 11, wherein the driving machine and the braking machine are electric motors and the electric motor of the braking machine for braking the mold train may be run as a generator which is joined for feedback control with the electric motor used as the driving machine and between the electric motor used as the braking machine and the braking wheels of the braking unit there is a free wheel to allow overtaking to take place once the braking wheel moved by the mold train has overtaken the electric motor used as the braking machine.

13. The apparatus as defined in claim 8, which further includes a supply unit for said conveyor placed upstream from the driving unit, said supply unit having at least one driving wheel joined by means of an adjustable slip clutch with its driving machine so that said driving wheel may be turned at a somewhat higher speed than the driving wheel of the driving unit.

14. The apparatus as defined in claim 8, for transporting molds with upright parting planes, wherein said transport structures take the form of walking beams able to be moved backwards and forwards on the wheels of the conveyor by a distance equal to at least the length of one mold and said walking beams are placed between supporting beams which are not moved in the transport direction and are designed running for the full length of the mold train, said support beams movable upwards for taking over the mold train so as to be higher than the top of the wallking beams, and for handing over the mold train back to the walking beams may be lowered to a lower level than the same, in that the wallking beams, after being moved forwards may be moved backwards with the mold train resting on the support beams and said supply units having a pusher carriage movable between the mold-producing station and the transport structure furthest to the back, said pusher carriage being moved by at least one driving wheel, and said mold coming from the mold-producing station may be pushed onto said carriage, the carriage having positioning parts for true positioning of the mold placed thereon and connected by guide parts with the transport structure next thereto.

15. The apparatus as defined in claim 14, wherein said pusher carriage is provided with rails turnable about a horizontal axis which is normal to the direction of transport through 90° for righting molds produced in the mold producing station with a horizontal parting line.

16. The apparatus as defined in claim 14, wherein the transport structures take the form of palettes running along at least one forward run and then back on a back run of said conveyor with turning supports and said palettes being moved over at the front end of each run of said conveyor using a moving over unit to the next run of said conveyor with turning supports and said palettes being supplied to the moving over unit by means of a change over part, coming after the braking unit and said change over part having at least one driving wheel joined by means of an adjustable slip clutch with its driving machine and said driving wheel being run at a speed which is a little higher than the speed of the driving wheel or supports of the driving unit.

17. The apparatus as defined in claim 16, wherein said adjustable slip clutches take the form of contactless magnetic clutches and more specifically magnetostatic hysteresis clutches.

18. The apparatus as defined in claim 8, wherein the side faces of the molds in the transport direction forming the mold train are reinforced by gripping plates supported by means of self-locking levers on a weighting iron adapted to be placed on the molds and which at the end of the conveyor run with turning support may be removed from the mold supplied to the shake-out station.

* * * * *